US010309630B2

(12) United States Patent
Cadisch et al.

(10) Patent No.: US 10,309,630 B2
(45) Date of Patent: Jun. 4, 2019

(54) LIGHT FITTING SYSTEM

(71) Applicant: ECOLED LIMITED, Hatfield (GB)

(72) Inventors: Simon Cadisch, Hertfordshire (GB); Riccardo Bellano, Hertfordshire (GB)

(73) Assignee: ECOLED LIMITED, Hatfield (GB)

( * ) Notice: Subject to any disclaimer, the term of this patent is extended or adjusted under 35 U.S.C. 154(b) by 0 days.

(21) Appl. No.: 15/533,117

(22) PCT Filed: Dec. 4, 2015

(86) PCT No.: PCT/EP2015/078734
§ 371 (c)(1),
(2) Date: Jun. 5, 2017

(87) PCT Pub. No.: WO2016/087668
PCT Pub. Date: Jun. 9, 2016

(65) Prior Publication Data

US 2017/0343195 A1 Nov. 30, 2017

(30) Foreign Application Priority Data

Dec. 5, 2014 (GB) ..... 1421695.6
May 29, 2015 (GB) ..... 1509342.0

(51) Int. Cl.
*F21S 8/02* (2006.01)
*F21V 17/10* (2006.01)
(Continued)

(52) U.S. Cl.
CPC ..... *F21V 21/30* (2013.01); *F21S 8/02* (2013.01); *F21V 17/101* (2013.01); *F21V 19/02* (2013.01);
(Continued)

(58) Field of Classification Search
CPC ..... F21V 19/02; F21V 19/04
See application file for complete search history.

(56) References Cited

U.S. PATENT DOCUMENTS 4,872,097 A * 10/1989 Miller ..... F21S 8/02 362/365
6,167,602 B1 * 1/2001 Yang ..... B25B 9/02 29/278
(Continued)

FOREIGN PATENT DOCUMENTS

GB 2517222 A 2/2015

OTHER PUBLICATIONS

International Search Report dated Feb. 22, 2016 for International Application No. PCT/EP2015/078734 filed Dec. 4, 2015.
(Continued)

*Primary Examiner* — Alexander K Garlen
(74) *Attorney, Agent, or Firm* — Avery N. Goldstein; Blue Filament Law PLLC

(57) ABSTRACT

A light fitting system has a light fitting for recessed mounting of a luminaire in a substrate such as a ceiling, which fitting comprises a luminaire support and a base for receiving the luminaire support and in relation to which base the luminaire support may be manipulated or moved or directed, and a tool for manipulating the luminaire support. The luminaire support and the luminaire support tool are configured for cooperative inter-engagement whereby the tool may be releasably inter-engaged with the luminaire support to enable manipulation of the luminaire support in relation to the base providing the advantage of a readily adaptable or manipulated luminaire support angularly adjustable or removable by means of the luminaire support tool thereby enabling adjustment and/or removal and replacement of a luminaire from a base without dismantling the fitting from the substrate into which it is mounted.

18 Claims, 14 Drawing Sheets

(51) Int. Cl.

| | |
|---|---|
| ***F21V 19/02*** | (2006.01) |
| ***F21V 19/04*** | (2006.01) |
| ***F21V 21/04*** | (2006.01) |
| ***F21V 21/30*** | (2006.01) |
| ***F21V 25/12*** | (2006.01) |
| ***F21Y 115/10*** | (2016.01) |

(52) U.S. Cl.
CPC ..... *F21V 19/04* (2013.01); *F21V 21/04* (2013.01); *F21V 25/125* (2013.01); *F21Y 2115/10* (2016.08)

(56) References Cited

U.S. PATENT DOCUMENTS

| | | | | |
|---|---|---|---|---|
| 6,371,628 | B1 | 4/2002 | Ward | |
| 2012/0033434 | A1 | 2/2012 | Wang | |
| 2012/0106177 | A1* | 5/2012 | Blankestijn | F21V 17/14 362/382 |
| 2013/0120992 | A1 | 5/2013 | Deurenberg et al. | |
| 2014/0268823 | A1* | 9/2014 | Mandy | F21V 19/0015 362/364 |
| 2015/0292692 | A1* | 10/2015 | Elmvang | F21S 8/026 362/294 |

OTHER PUBLICATIONS

UK Search Report dated Apr. 9, 2015 for UK Application No. GB1421695 filed Dec. 5, 2014.

* cited by examiner

LIGHT FITTING SYSTEM

The present invention relates to a light fitting system for recessed mounting of a luminaire in a substrate which allows a user to manipulate the luminaire or its support in the light fitting, a tool for this purpose and a luminaire support adapted to be manipulated.

Lights recessed within walls or ceilings have been popular in the commercial environment for some time. The display industry, in particular in department stores, has used recessed light fittings for some time. A single light fitting may be used to project light over a general area or it may be used to project light at a particular object. Recessed light fittings have become popular in other situations, like, for example, the domestic environment. This popularity has gathered pace with advances in technology that have resulted in light-emitting diodes becoming a viable alternative light source to filament lamps. For the sake of brevity, the conventional term "LED" shall be used to describe a light-emitting diode hereon.

Patent publication US2012/0033434 discloses a light fitting for adjustable recessed mounting of a luminaire in a substrate. The light fitting comprises a base with a substantially semi-spherical cavity defined therein and a casing pivotally disposed in the cavity. The casing is movable relative to the cavity along the semi-spherical shape of the cavity. The casing comprises LEDs for providing illumination through a lens. The light fitting comprises a housing with a cover which protectively shields the base and the casing. The cover has an accommodating hole through which the base partially protrudes. The LEDs may be pivoted to project light at various angles in relation to the general area.

The popularity of recessed light fittings is complemented by a need for economic installment techniques. Whilst the light fitting of US2012/0033434 may have adjustable light projection, the adjustable components are a pre-assembled unit of the base plus the casing including the LEDs which are enclosed within the casing. Renewal, or repair, of the LEDs requires removal of the cover to gain access with the attendant risk that, in the process, the cover may or its fasteners may be damaged or mislaid. Then the base must be unscrewed from the housing. This makes heavy and repetitive work for the user. Maintenance of the light fitting of US2012/0033434 is an inflexible process which takes time and effort.

It is an object of the present invention to provide an improved light fitting system.

Accordingly, in a first aspect of the present invention, there is provided a light fitting system comprising a light fitting for recessed mounting of a luminaire in a substrate, the light fitting comprising a luminaire support and a base for receiving the luminaire support; and a luminaire support tool for manipulating the luminaire support in relation to the base of the light fitting, wherein the luminaire support and the luminaire support tool are configured for cooperative inter-engagement whereby the tool may be releasably inter-engaged with the luminaire support to enable manipulation of the luminaire support in relation to the base.

In a second aspect of the invention, there is provided a luminaire support tool for manipulating a luminaire support in relation to a base of a light fitting and for use in a light fitting system as defined above.

In a third aspect of the invention, there is provided a luminaire or luminaire support for use in a system as defined above.

In a fourth aspect of the invention, there is provided a method of manipulating a luminaire support the method comprises providing a luminaire support as defined above preferably having one or more recess formed in a hollow central channel in the luminaire support, which recess is configured to receive a corresponding protrusion; providing a luminaire support tool as defined above preferably having one or more laterally extending protrusion for inter-engagement with a recess of the luminaire support; causing the tool to adopt a second released configuration in which its one or more protrusions are retracted; passing an operational end of the tool via a mouth of the luminaire support into a hollow central channel defined by an internal surface of the luminaire support to a position whereby the retracted protrusion are aligned with the corresponding one or more recess of the luminaire support; actuating the tool to cause it to adopt a first engaged configuration whereby the protrusions extend into to inter-engage with the one or more recess of the luminaire support; and whilst in inter-engagement, manipulating the tool in order to correspondingly manipulate the luminaire support in the desired manner.

According to the above aspects of the invention, the manipulation of the luminaire support, which optionally carries (either as a separable or integral part) a luminaire element, comprises one or more of fitting, removing or adjusting the luminaire in relation to the base. Luminaires which are adjustable in angle relative to a base are fiddly to manipulate and the system, tool and luminaire support of the present invention facilitate such movement. Some light fittings, especially of the type discussed in aspects of the invention below, may enable push-fit fitting of a luminaire support in a base which luminaire support may be correspondingly pulled to remove it. The system of the invention may be configured for manipulation of the luminaire support which comprises one or more of fitting, removing and adjusting the luminaire support in relation to the base.

Preferably, in the light fitting system the base and luminaire support are configured such that the base may removably receive the luminare support and/or enable angular adjustment of the luminaire support within the base, for example in the manner described in the sixth and further aspects of the invention below. As such, the light fitting system preferably comprises a base having a socket portion for removably receiving the luminaire support and wherein the luminaire support and the tool are configured to enable fitting and/or removal of the luminaire support into or from the socket portion of the base. Preferably, the base comprises a base collar defining the socket portion and having an outer opening or mouth and wherein the luminaire support may be fitted and removed from the socket portion via the mouth.

Inter-engagement of the luminaire support and the tool is preferably by configuring both with one or more cooperating recesses and protrusions for cooperative inter-engagement. These recesses and protrusions are preferably a laterally extending recess and a laterally extending protrusion. Preferably, the luminaire support comprises a laterally extending recess configured to receive a cooperating laterally extending flange member disposed on the luminaire support tool.

Preferably, the luminaire support has an interior surface defining a hollow central channel, longitudinally disposed in the luminaire, configured to receive passage of the tool and wherein the laterally extending recess is disposed in the interior surface and extends from the hollow central channel.

The luminaire support tool of the above aspects of the invention is preferably a hand tool having a first configuration in which the tool adopts an engaged configuration in which it can be cooperatively inter-engaged with a corresponding luminaire support and a second configuration in which the tool adopts a released configuration in which it may not be cooperatively inter-engaged with a luminaire support and may be moved independently of the luminaire support. Preferably, the tool may be moved between its first and second configurations by a one hand operation.

In a preferred embodiment, the tool comprises an elongate handle portion and disposed on a distal end thereof an operational portion, wherein the operational portion is provided with one or more protrusions and/or recess for inter-engagement with one or more corresponding recesses and/or protrusions disposed on a luminaire support. Preferably, the operational portion is provided with two laterally outwardly extending protrusions.

Preferably, the tool is biased toward either its first or second configuration and then may be actuated to adopt the other configuration. Preferably, the tool is biased toward its second, released, configuration (e.g. by a retention means) so that it must be actuated toward its first, engaged, configuration when inter-engaging with a luminaire support. The retention means may be any suitable means for retaining the tool in one configuration but capable of being overcome during actuation of the tool to the other configuration, but preferably is a resiliently adaptable retention means such as a spring or resilient elastomeric member. In a preferred embodiment, in which the tool is biased to its second relaxed configuration, the retention means is a resilient elastomeric member fitted about an operational end of the tool to bias it to that configuration. Preferably, the retention means is an o-ring disposed in a channel to receive it about the operational end of the tool.

On actuation of the tool to its engaged configuration, it is preferably provided with a securing member, which may also be an o-ring provided on the tool, moveable between a relatively neutral stowed position to a securing position when the tool is in its engaged configuration.

The luminaire support for use in the above system and according to an aspect of the invention preferably has a head portion at its outer end and formed therein a central hollow channel defined by an internal surface of the head portion which channel extends outwards to a mouth for the escape and direction of light from the luminaire, wherein one or more laterally extending protrusions and/or recesses are formed by the internal surface extending into or from the central hollow channel for inter-engagement with a correspondingly configured luminaire support tool.

Preferably, a laterally extending annular recess is formed by the internal surface extending from the central hollow channel for inter-engagement with a correspondingly configured luminaire support tool.

In a fifth aspect of the invention, there is provided a tool moveable between a first configuration and a second configuration having an elongate handle portion and at a distal end thereof an operational portion separated from the handle portion by a pivot joint, wherein the tool comprises two tool halves each having opposing internal facing surfaces defining respective surface planes, wherein the surface plane of each handle portion is disposed at an obtuse angle to the surface plane of each operational portion, whereby the tool halves may be caused to pivot about the pivot joint between the first configuration in which opposing surface planes of the operational portion of each tool half is brought together and the second configuration in which opposing surface planes of the handle portion of each tool half is brought together.

Preferably the tool according to this aspect is adapted for use as a tool according to the aspects above and in the system defined above.

Whilst the tool halves may optionally be machined, e.g. from aluminium, preferably, in the tool of this aspect, each tool half is formed by moulding in a mould. Preferably, in this and other aspects of the invention, the tool is moulded from a plastic material (such as, for example, acetal, acrylic, polypropylene, polyamide, polyester, polyethylene, polycarbonate or any other suitable material). Preferably, the tool is formed by injection moulding.

In this aspect of the invention, each tool half of the tool preferably comprises a handle portion an operational portion and therebetween a pivot joint half. The pivot joint preferably comprises a roller bearing disposed in a cavity formed by corresponding pivot joint halves of each tool half when brought together. The tool halves are held together to form the tool by resiliently flexible retention members disposed around the two halves. Preferably, there are two retention members which are o-rings disposed in channels configured to receive them. Preferably the tool further comprises a laterally outward extending flange member disposed on the operational portion of each tool half whereby in its first configuration the flange members are in retracted configuration and in its second configuration the flange members are in extended configuration.

Preferably in embodiments of the above aspects of the invention the cooperating tool and luminaire support may inter-engage sufficiently to put the invention into effect and more preferably with an overlap or to an extent of at least 1.5 mm, more preferably at least 2 mm and optionally from 3 mm up to say 5 mm. For example, the recesses may have a depth of from 2 to 5 mm whilst the flange members when in engaged position may extend at least 1.5, more preferably at least 2 mm into the recess. Preferably the cooperating flange members and recesses extend generally perpendicularly from the longitudinal axes of the respective luminaire support ant tool.

The tool is configured to fit into the hollow channel with some clearance. The recess, which is preferably disposed in the hollow channel at or close to its narrowest point (since it tends to flare from inside to out), is preferably formed in or close to the throat where the diameter may be, for example, from 15 to 25 mm, e.g. 28 to 22 mm and most typically about 20 mm, excluding the depth of the recess itself. The tool, in its released configuration, may have several mm clearance each side, e.g. at least 1 mm and up to 3 mm, preferably 1.5 mm to 2 mm.

The invention offers the particular advantage of a readily adaptable or manipulable luminaire support and where so configured angularly adjustable or removable by means of the luminaire support tool. In combination with the aspects below, the light fitting system enables adjustment and/or removal and replacement of a luminaire from a base without dismantling the fitting from the substrate into which it is fixed. Thus, access to replace a luminaire or to access the electrical wires or other electronics from behind the luminaire may be facilitated without dismantling or removing the base or part thereof and thus without disturbing or damaging a substrate into which it may be mounted.

In a sixth aspect of the present invention, there is provided a light fitting for recessed mounting of a luminaire in a substrate, the light fitting comprising: a luminaire support having an expanded waist portion; and a base having a socket portion arranged to receive the waist portion, wherein angular orientation of luminaire support in relation to the base is adjustable by way of relative movement between the socket portion and the waist portion and wherein at least one of the socket portion or waist portion has a resilient member arranged to releasably retain the waist portion in the socket portion.

Preferably, the light fitting of this aspect is adapted for use with the first to fifth aspects of the invention described above. In particular, it is preferred that the light fitting of this aspect and the luminaire support of this aspect are adapted by providing a recess or protrusion (preferably a recess and more preferably an annular recess) for inter-engagement with a corresponding recess or protrusion of a luminaire support tool. Preferably, such a recess is provided in a central hollow channel defined in the luminaire support.

The light fitting of the present invention permits adjustment of the angular orientation of luminaire support in relation to the base. This allows the light projected from the luminaire to be adjusted to a range of locations and user preferences. Advantageously, the resilient member permits easy and quick release of the luminaire support from the base. Release of the luminaire support from the base is possible by manipulation of the luminaire support, with or without the assistance of a tool. Advantageously, release of the luminaire support from the base is also reversible because the resilient member automatically recovers its original form. Thus, the resilient member permits quick and easy recoupling and retention of the luminaire support to the base. The luminaire support may simply be plugged into, or unplugged from, the base.

These features of the present invention enable the base to be connected to the substrate, like, for example, a wall or ceiling, without the luminaire support. This reduces the weight of the installation task because only the base may be installed initially. The luminaire support may be coupled, possibly tool-free, to the base later. For example, a batch of bases may be installed and then the luminaire supports are coupled to the bases later when the electrical power supply cables are ready for connection. Alternatively, a luminaire support, equipped with luminaire, may be decoupled and repaired or replaced while the base remains undisturbed. The user can manipulate the electrical power supply cables and connect them to a freestanding luminaire in the luminaire support before the latter is re-coupled to the base. Luminaire supports, each with LED luminaire, may be retro-fitted in place of filament lamps, again without disturbing the base. These are some examples of how the present invention provides a flexible and cost effective light fitting. Once the luminaire support is coupled to the base, angular orientation of luminaire support in relation to the base can be easily adjusted and allow the user to proceed to the next job.

Optionally, a luminaire tool as defined herein may be used to adjust, fit and/or remove a luminaire.

Preferably, the relative movement between the socket portion and the waist portion is supported by an at least partially spherical surface on at least one of the socket portion and the waist portion. The at least partially spherical surface provides a simple means for rotational and/or pivotal adjustment of the luminaire support in relation to the base.

The or each partially spherical surface may circumscribe the socket portion or waist portion. This may assist rotational and/or pivotal adjustment of the orientation of luminaire support in relation to the base around 360 degrees.

Preferably, the at least partially spherical surface is on one of the socket portion or the waist portion and the other of the socket portion or the waist portion comprises a stop arranged to support the at least partially spherical surface between the stop and the resilient member. The stop limits insertion of the luminaire support inside the base. This may help prevent the luminaire support, and the luminaire connected thereto, from receding too far inside a hole in a substrate and being lost.

Preferably, the stop comprises an at least partially annular flange circumscribing the other of the socket portion or the waist portion. The flange may assist rotational and/or pivotal adjustment of the orientation of luminaire support in relation to the base.

Preferably, the flange circumscribes a channel through the base. Electrical power supply cables destined for a luminaire may pass through the base, via the channel. The luminaire support may be coupled to the base simply by pushing it, the luminaire and the power supply cables back up the channel and through the case until the luminaire support abuts the flange. In this arrangement, the stop may resemble an annular flange.

Sometimes, the luminaire support may be urged in the direction of the base. This could occur if, for example, the light fitting was used in a side of a swimming pool with water pressure continually acting upon the luminaire support. Preferably, the light fitting comprises a cushion between the stop and the at least partially spherical surface. This may absorb at least some of the force acting on the luminaire support and reduce friction between the luminaire support and the base. Preferably, the cushion comprises an o-ring. The o-ring may provide support to the at least partially spherical surface while the waist portion moves about the the socket portion. The o-ring may also act as a seal between the waist portion and the socket portion.

The resilient member may be any device, like, for example, a body made of inherently resilient material such as rubber or a detent such as a finger or ball biased by a spring. Preferably, the resilient member comprises an o-ring. The o-ring may provide support to movement between the waist portion and the the socket portion while also releasably retaining the waist portion in the socket portion. O-rings are readily available and easily serviceable components, should the need arise.

Preferably, the base comprises a collar configured for recessed mounting in a substrate. The collar may provide a hollow, generally cylindrical, shape adapted to brace the light fitting in hole in a substrate while also to receive and support electrical power supply cables, a luminaire and a luminaire support.

The base may comprises an outer flange configured for engagement with a substrate. This helps to prevent the base receding too far within a hole in a substrate. The outer flange may have an array of perforations. The outer flange may be plastered over to help conceal all but light from the light fitting. The perforations help adhesion of the plaster to the outer flange and help key the base into the substrate.

The light fitting may comprises a luminaire connected to the luminaire support. Thus, the light fitting is ready for connection to an electrical power supply and for use. Alternatively, the luminaire support may integral with the luminaire. This reduces components and may reduce manufacturing costs which could be passed on to the customer.

The waist portion may be releasable from the socket portion by way of manual grip of the luminaire support optionally facilitated by finger grip on the luminaire support or by way of manipulation with a tool.

According to a seventh aspect of the invention, there is provided a base having a socket portion arranged to receive an expanded waist portion of a luminaire support of the light fitting of the above aspects, wherein angular orientation of luminaire support in relation to the base is adjustable by way of relative movement between the socket portion and the waist portion, wherein said relative movement is supported by an at least partially spherical surface on at least one of the socket portion and the waist portion and wherein at least one of the socket portion or waist portion has a resilient member arranged to releasably retain the waist portion in the socket portion.

According to a eighth aspect of the invention, there is provided a luminaire support having an expanded waist portion to be received in a socket portion of a base of the light fitting of the above aspects, wherein angular orientation of luminaire support in relation to the base is adjustable by way of relative movement between the socket portion and the waist portion, wherein said relative movement is supported by an at least partially spherical surface on at least one of the socket portion and the waist portion and wherein at least one of the socket portion or waist portion has a resilient member arranged to releasably retain the waist portion in the socket portion.

These and other features and advantages of the present invention will be better understood from the following detailed description, which is given by way of example and with reference to the accompanying drawings, in which:

FIG. 1 shows in perspective view a tool and luminaire in one embodiment of a system of the present invention.

FIG. 2*a* shows in perspective view a tool and luminaire of FIG. 1 in one inter-engaged configuration FIG. 2*b* shows in perspective view a tool and luminaire of FIG. 1 in a second inter-engaged configuration FIG. 3 illustrates in cross sectional view an embodiment of a luminaire support and tool engaged therewith of a system of the present invention FIG. 4 shows in perspective view a tool according to one embodiment of one aspect of the invention in its second, released, configuration.

Figure 1:
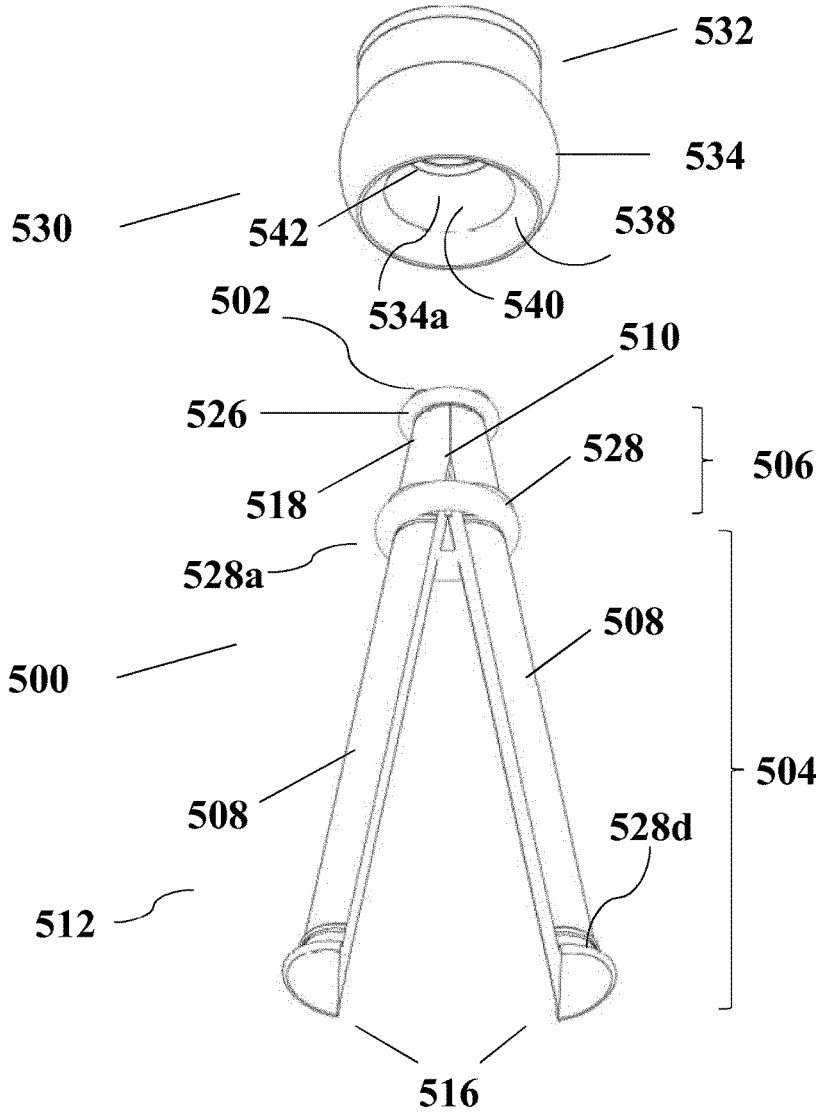

Referring to FIG. 1, which illustrates a luminaire support 530 and a luminaire support tool 500 for use in relation to a system of the present invention. The luminaire support 530 has a hollow cylindrical tail portion 532 (e.g. to support a luminaire or luminaire parts) at the inner end of the luminaire 530. The tail portion 530, in use, would typically be inserted (with a luminaire or luminaire parts fitted) into the mouth of a base (not shown). And the luminaire support has an expanded part-spherical head portion 534 at an outer end of the luminaire support 530. A central longitudinal axis is defined by the head portion 534 and tail portion 532. The head portion 534 has a hollow central channel 534*a*, defined by interior surface 540, which extends from within the luminaire support 530 (e.g. from the tail portion 532 or from part within the head portion 534) to the outer end or mouth 538 of the head portion 530. Typically, lodged in the throat (not shown) of the central channel 534*a* is a transparent lens or window (not shown). The diameter of the central channel 534*a* typically tapers out at increasing gradient toward the mouth 538. Formed in the interior surface 540 and extending laterally outward from the interior channel 534*a* is annular recess 542 for receiving corresponding laterally extending protrusions or flange members 502 on the tool 500.

The luminaire support tool 500 comprises an elongate handle portion 504 and disposed at a distal end thereof an operational portion 506. Two laterally extending protrusions or flange members 502 extending in opposing lateral directions are disposed on the distal end of the handle portion 504. These flange members 502 are better illustrated in FIGS. 3, 4 and 5. The tool 500 is configured to releasably inter-engage with the luminaire support 530. This is achieved via movement of the tool 500 between first and second configurations by hand operation, namely squeezing and releasing the handle portion 504. The tool 500 is shown in FIG. 1 in its second, released, configuration 512 (also shown in FIG. 4) in which it is not inter-engaged with the luminaire support 530. In this second configuration, the flange members 502 are retracted (see also FIG. 4) and the handle members 508 are open (or separated from one another). By squeezing the handle members 508 together, the tool may move to its first, engaged, configuration 514 (see FIGS. 2, 3 and 5).

The tool 500 is formed of two tool halves 516. Each tool half 516 has a handle member 508 and an operational member 518 and each operational member 518 has in fixed relationship therewith a laterally extending protrusion or flange member 502. The tool halves 516 when placed together pivot relative to one another about a pivot point 510 facilitated by roller bearings 520 (e.g. cylinder roller bearings) disposed in a cavity 522 formed by a correspondingly (e.g. a semi cylindrical) shaped recess on the inner surface of each tool half 516 about pivot point 510. The use of a roller bearing 520 as well as facilitating pivoting of the tool halves 516 relative to one another help maintain alignment of the two tool halves 516 in use. Each tool half 516 has a planar inner surface 524, comprising a handle inner surface 524*a* and an operational member inner surface 524*b*, which adopt different planes to one another disposed at an obtuse angle relative to one another. The two surfaces 524*a* and 524*b* meet at or close to pivot point 510 (or the pivot point cavity). In the second, released, configuration (shown in FIG. 1), the tool halves 516 are in a configuration where the two handle members 508 are open or separated and the two operational members 518 are closed or together and the flange members 502 can be said to be retracted (see FIGS. 1 and 4). The operational members 518 are retained in their closed relationship (in which the operational member surfaces 524*b* of each tool half 516 are typically touching or adjacent and largely co-planar) position by resilient retention member 526, which is typically an O-ring disposed in a channel formed about the outer surfaces of the operational portion 506. Thus, the tool is biased by the O-ring in its second, released, configuration.

Figure 5:
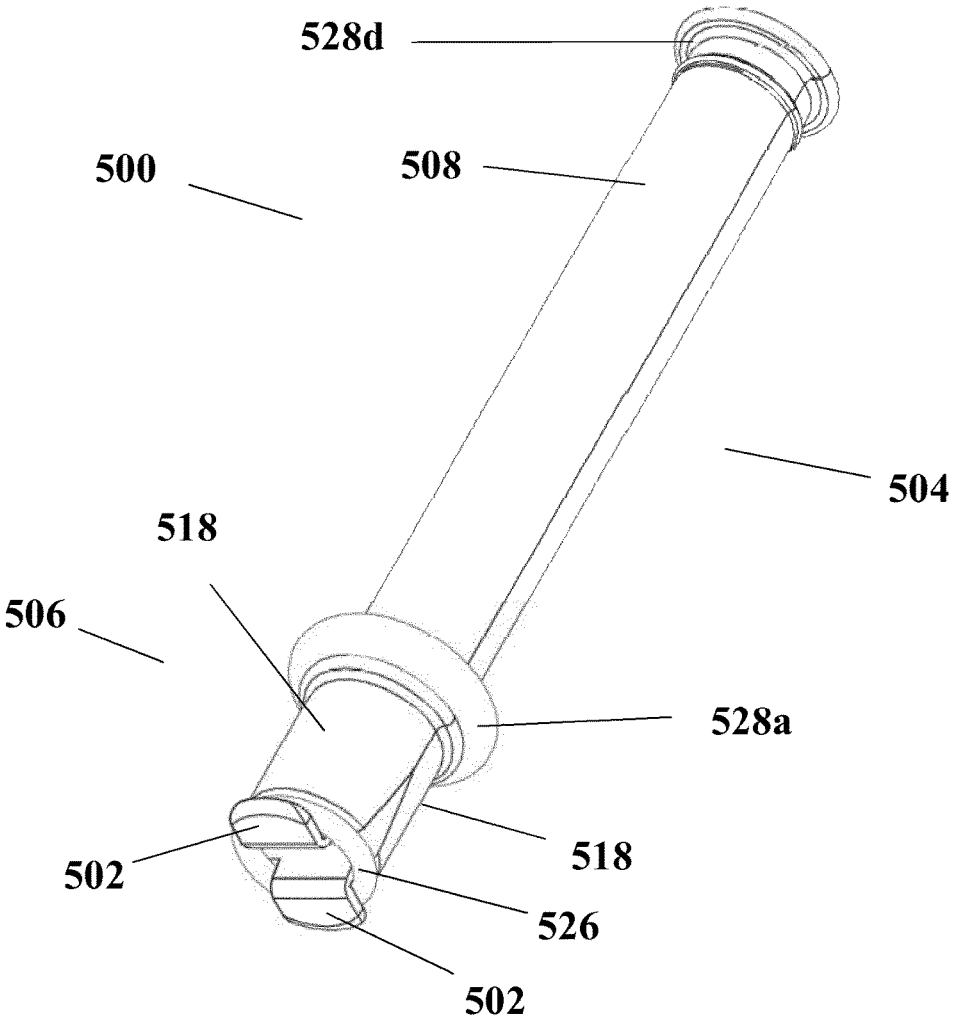
FIG. 5 shows in perspective view a tool of FIG. 4 in its first, engaged configuration.
Figure 6:
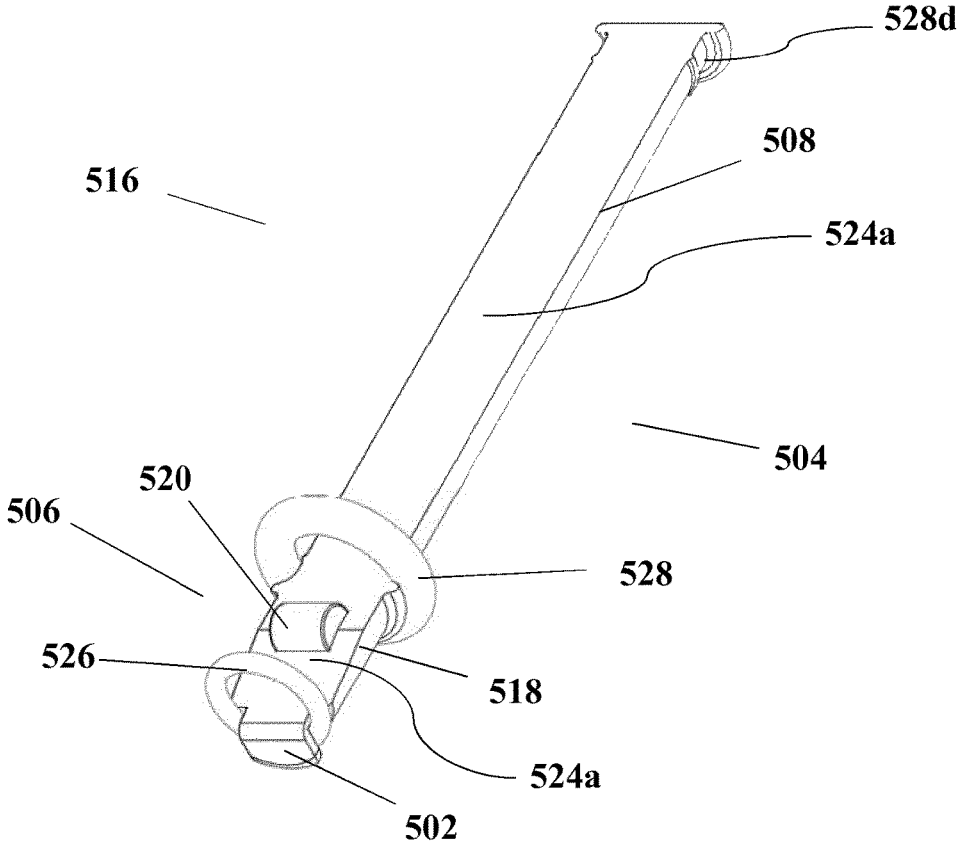
FIG. 6 shows in perspective view a tool half of a tool of FIGS. 4 and 5.
Figure 7:
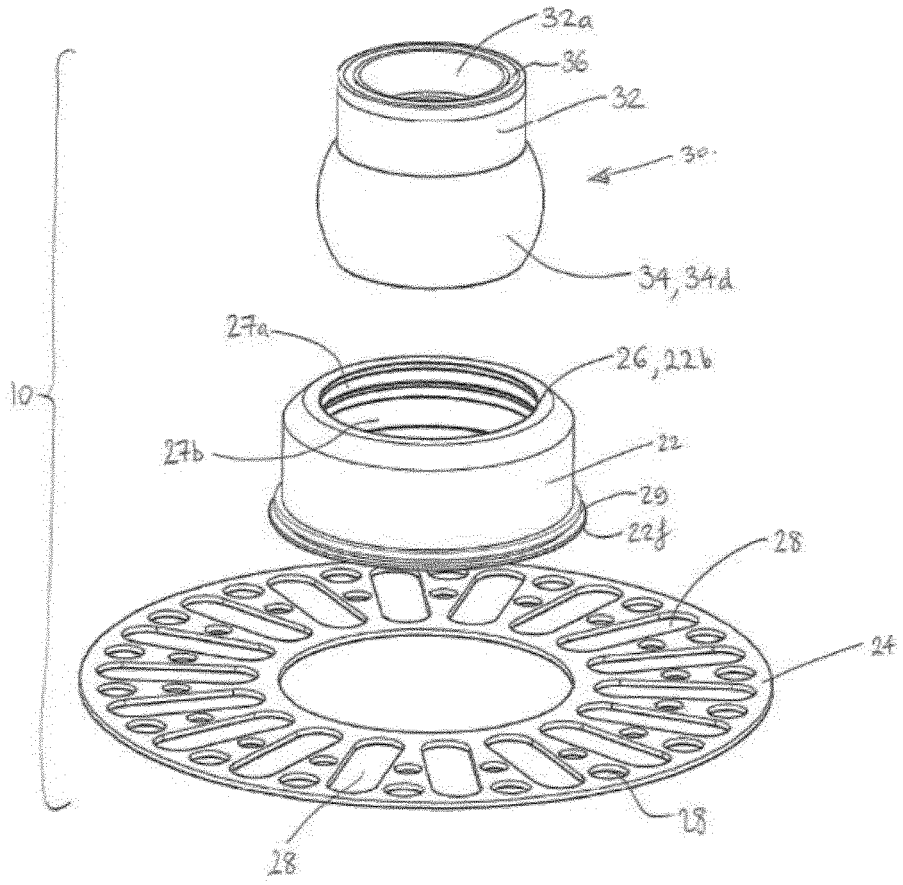
FIG. 7 shows an exploded perspective view of a light fitting.
Figure 8:
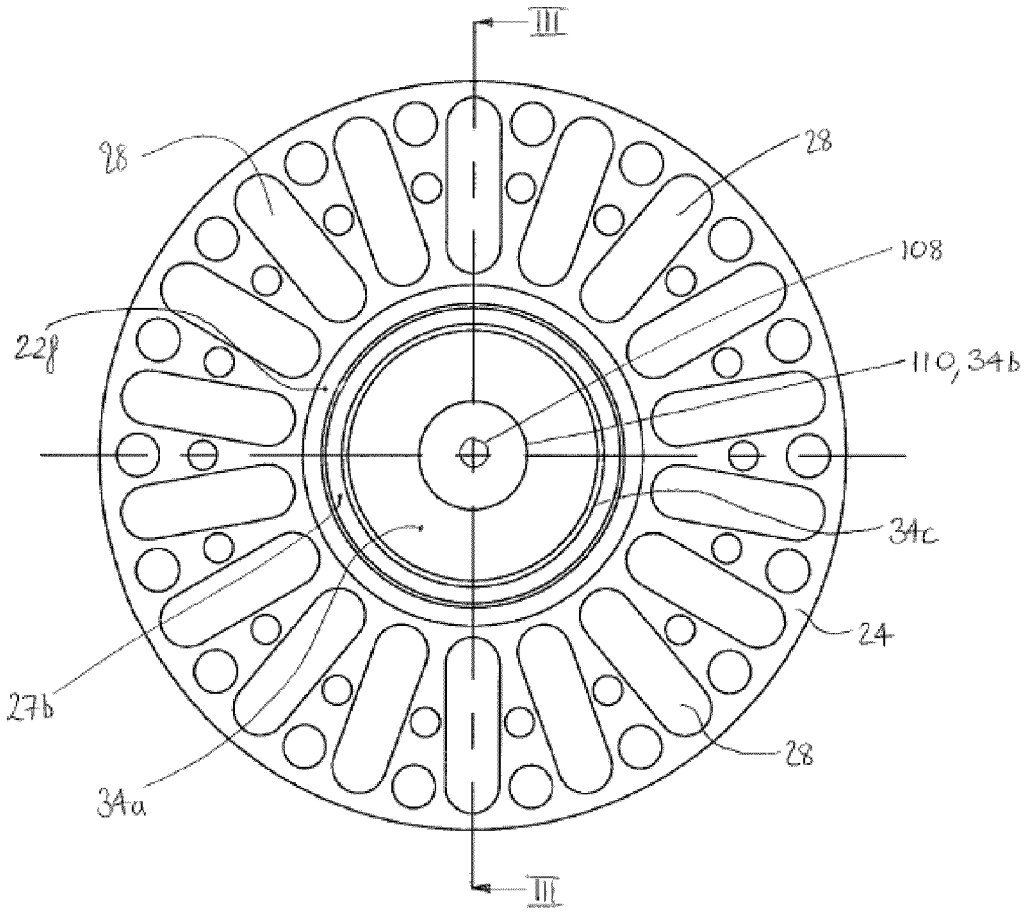
FIG. 8 shows a bottom view of the light fitting mounted of FIG. 7.
Figure 9A:
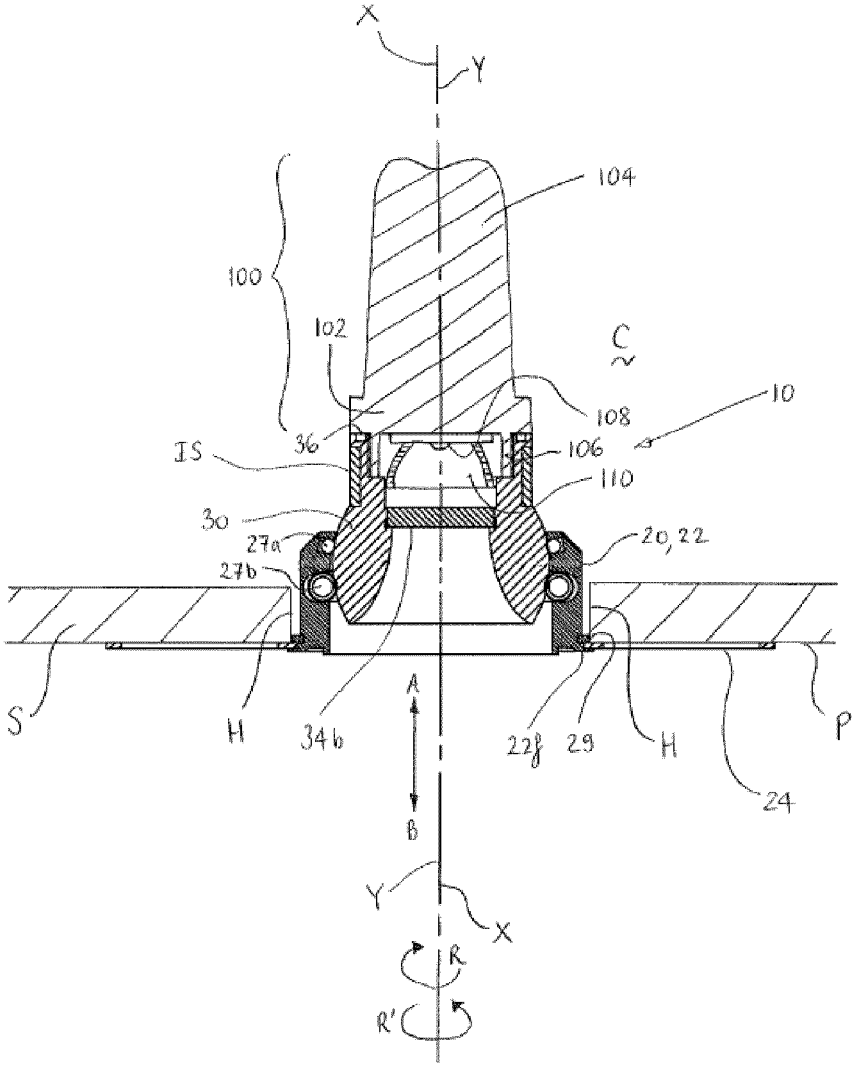
FIG. 9 shows a cross-section III-III of the light fitting of FIG. 7 with a luminaire and in a recess in a substrate.
Figure 9B:
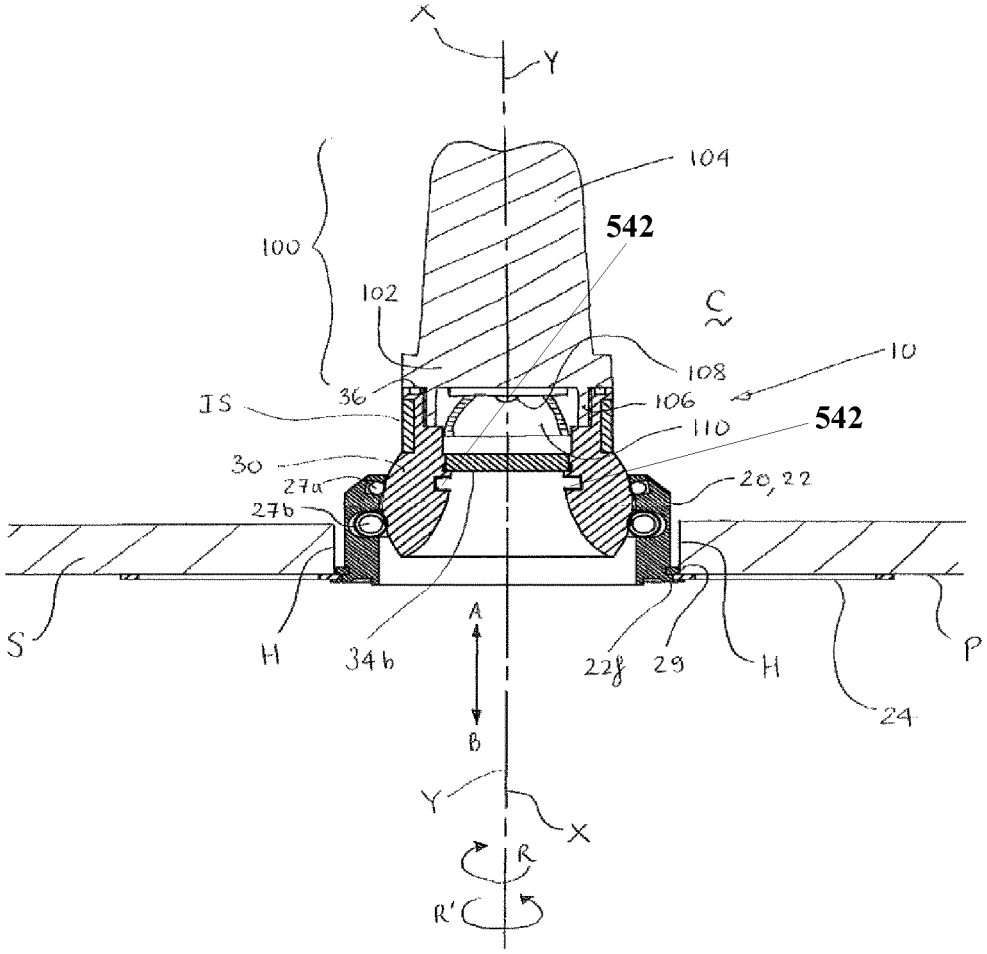

The tool 500 may be actuated to its first, engaged, configuration by squeezing together handle members 508 until the handle surfaces 524*a* are touching one another. By squeezing together handle members 508, the tool halves 516 pivot about pivot point 510 against the bias provided by the retention member 526 causing the operational portions 506 of the tool halves 516 to separate or open. The flange members 502 may then be said to adopt an extended configuration in which when properly located may inter-engage with a corresponding recess 542 in the internal surface 540 of the luminaire support 530. Once the handle surfaces 524*a* are touching and the operational portions 506 of the tool halves 516 are fully separated, or at least sufficient to enable the flange members 502 to inter-engage with a corresponding recess 542, the tool can be said to have adopted its first, engaged, or deployed configuration, as shown in FIGS. 2, 3 and 5.

In use, a tool 500 may be held in its second configuration, in a relaxed grip by a user of handle portion 504. The operational portion 506 may be inserted into the central channel 534*a* of a luminaire support 530 via its mouth 538 to an extent until the flange members 502 are aligned with an annular recess 542 formed in the interior surface 540 of the luminaire support 530, which may be when the flange members 502 abut a glass window (or lens) 534*b* which is disposed in the throat of the channel 534*a*. The handle members 508 may then be squeezed together in a manner discussed above until flange members 502 extend into annular recess 542. The tool 500, in its first engaged configuration, is then inter-engaged with the luminaire support 530 such that the luminaire support may be manipulated by the tool, whether that is inserting into a socket of a base, removing from a socket of a base or adjusting the angle of the luminaire support within the base.

The tool 500 may be secured in its first engaged configuration by use of a securing member which is preferably a securing ring 528 (preferably a second O-ring) which may be slid out along the length of the handle portion 508 (about which it is disposed) from a stowed position 528*a* (e.g. in a channel 528*b* configured to receive it) to a deployed position 528*c* (e.g. in a channel 528*d* configured to receive it). In its deployed position 528*c* it is essentially disposed at the proximal end of the handle portion 504. This prevents the tool 500 from reacting to the bias of the retention member 526 and holds the tool 500 in its first engaged configuration until such time as the securing ring 528 is returned to its stowed position 528*a* being a neutral position close to the pivot point 510.

Figure 2A:
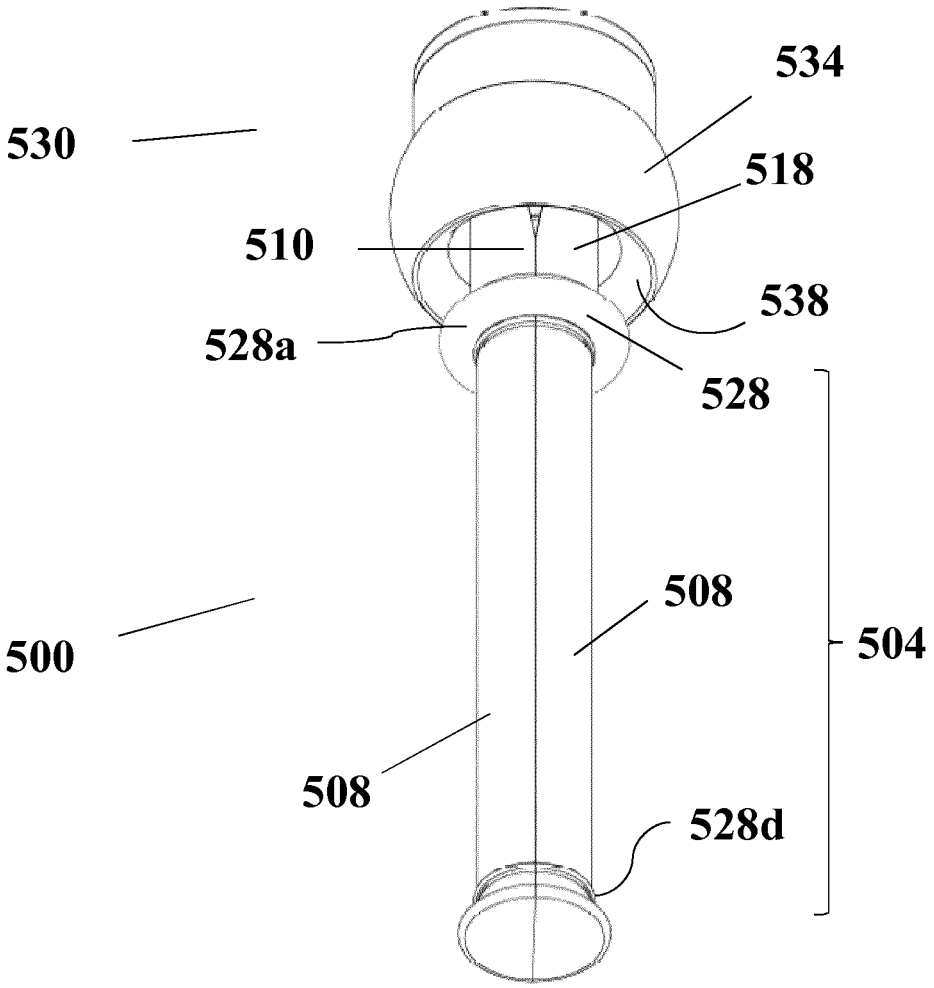
Figure 2B:
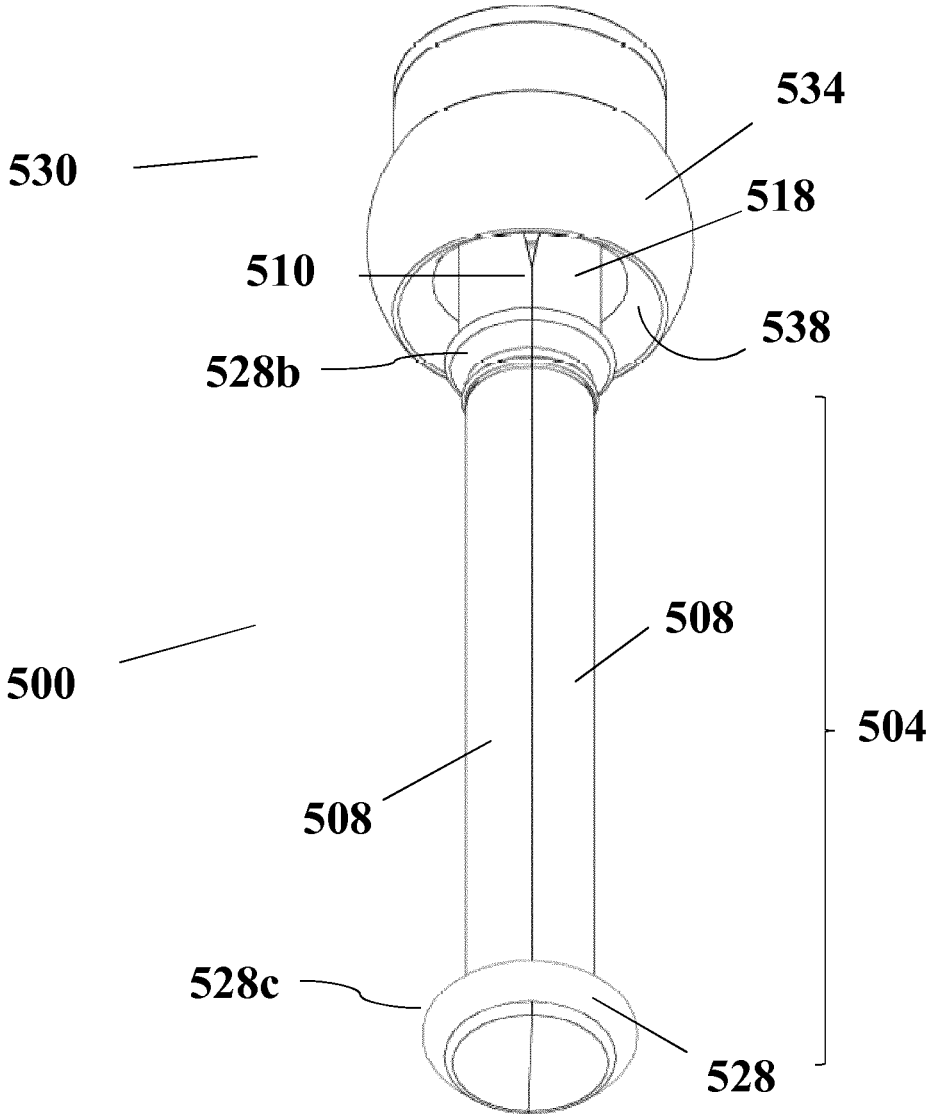
Figure 3:
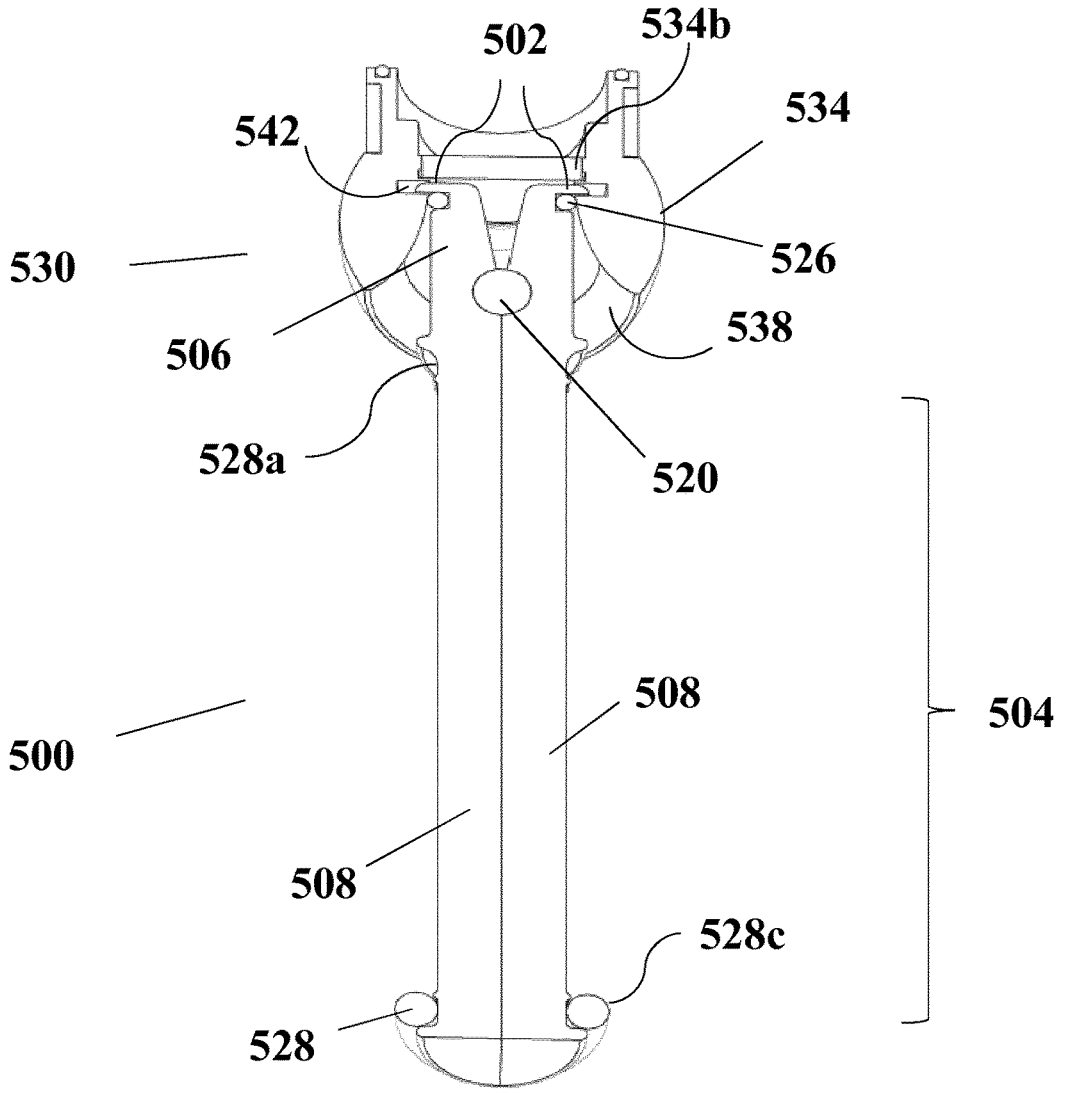
Figure 4:
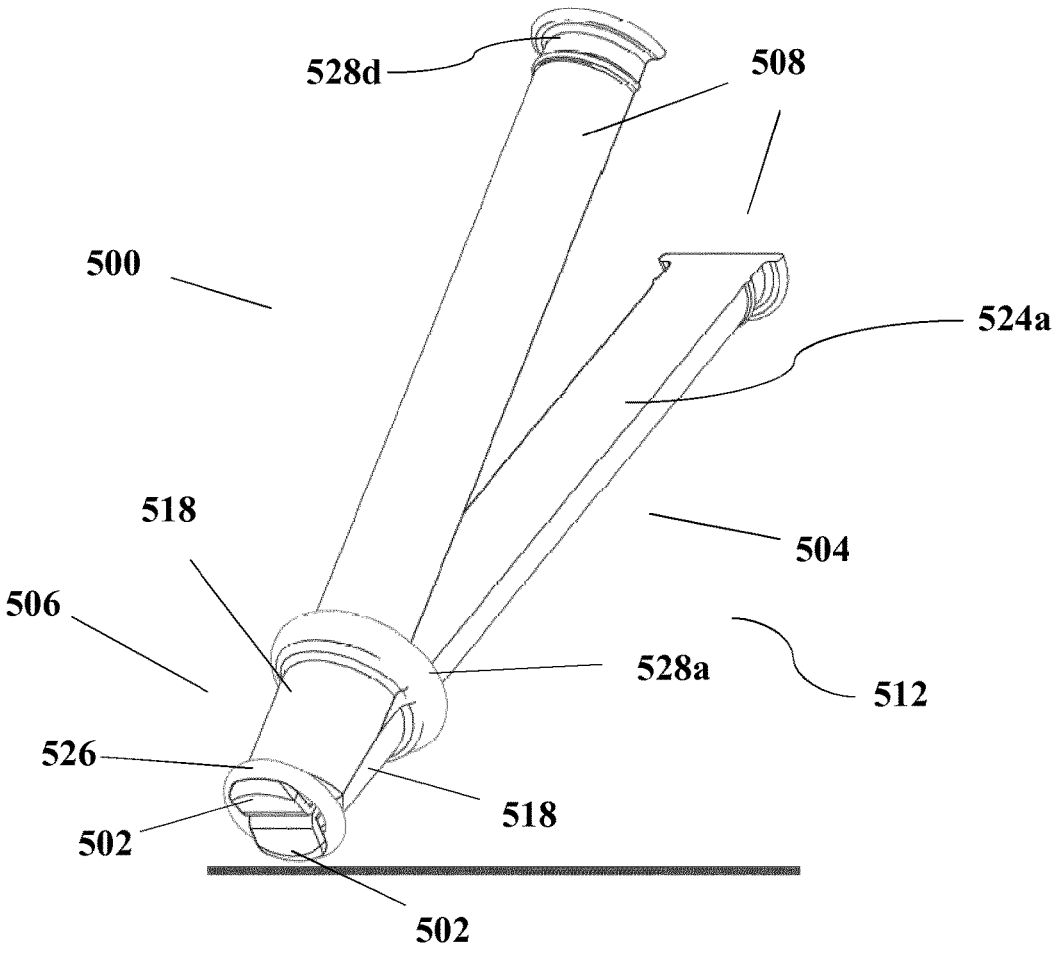

Once in its first engaged configuration and inter-engaged with a luminaire support 530 as shown in FIGS. 2, 3 and 4, the tool 500, the tool may be used to manipulate the luminaire support 530. This may be, for example, changing the angle of the luminaire support 530 relative to the base (not shown) in order to direct the light where desired, or it may be, for example, to enable a luminaire 530 held in a base (not shown) by way of a releasable ball and socket arrangement being removed from the base by simply pulling the tool.

On completion of the manipulation of the luminaire support 530 by the tool 500, the securing ring 528 may be moved to its stowed position 528*a* and then grip upon the handle members 508 released in strength until the bias of the retention member 526 dominates pulling the operational portions 506 of the tool halves 516 together and causing the handle members 508 to separate, until the flange members 502 become retracted from the annular recess 542. The tool 500 may then be withdrawn from the central channel 534*a* of the luminaire support 530.

Referring to FIGS. 7 to 11, there is shown a light fitting 10 for recessed mounting of a luminaire 100 in a substrate S which allows a user to adjust the direction of light projected from the light fitting 10. The light fitting 10 in FIGS. 7 to 10 is preferably adapted for use in a system as described in accordance with aspects of the present invention and described above with reference to FIGS. 1 to 6.

The substrate S (shown in FIGS. 9*a* and 9*b*) may be, for example, a plasterboard wall or ceiling, or ceiling tile, that is a facade to a cavity C large enough to accommodate the light fitting 10, the luminaire 100 and its associated electrical power supply cables (not shown). Alternatively, the substrate S may be, for example, a solid wall formed with a recess to accommodate the light fitting 10 and the luminaire 100 and provide a conduit for its electrical power supply cables. The light fitting 10 typically mounts a luminaire 100 having an external diameter of about 55 mm to 75 mm but its simple design makes it suitable for mounting a luminaire having a much smaller, or bigger, external diameter.

For clarity, arrow A indicates the direction of the inner end, and arrow B indicates the direction of the outer end, of the light fitting 10 and its components.

The light fitting 10 comprises a hollow generally hat-shaped base 20 for connection to the substrate S and a luminaire support 30 for supporting a luminaire 100. The luminaire support 30 is adjustably coupled to the base 20 by an adjustable coupling mechanism, as is described in more detail below. The adjustable coupling mechanism may permit the luminaire support 30 to be coupled and decoupled from the base 20 by manipulation of the luminaire support 30, as is also described in more detail below.

The base 20 comprises a hollow cylindrical collar 22 having a central longitudinal axis X-X and a wide annular outer flange 24 arranged about an outer end 22*a*, or mouth, of the base collar 22 in a plane P orthogonal to the longitudinal axis X-X. The base 20 further comprises an annular inner flange 26 arranged around the interior of an inner end 22*b* of the base collar 22 opposite to the outer end 22*a* of the base collar 22. The base collar 22 and the outer flange 24 of the base 20 are made as separate parts assembled together, although, optionally, the may be made as an integral part. The base 20 may be made of any suitable substantially rigid material, provided it is fire retardant, like for example, metal, ceramic, plastic, fibre glass or composite material.

The outer flange 24 has an array of perforations 28 of various shapes and sizes. When the light fitting 10 is mounted in a recess of a substrate S, the outer flange 24 is relatively thin and it may be plastered over to conceal the base 20 within the substrate S. The perforations 28 help to key the outer flange 24 into the layer of plaster to improve connection of the light fitting 10 to the substrate S.

Figure 10:
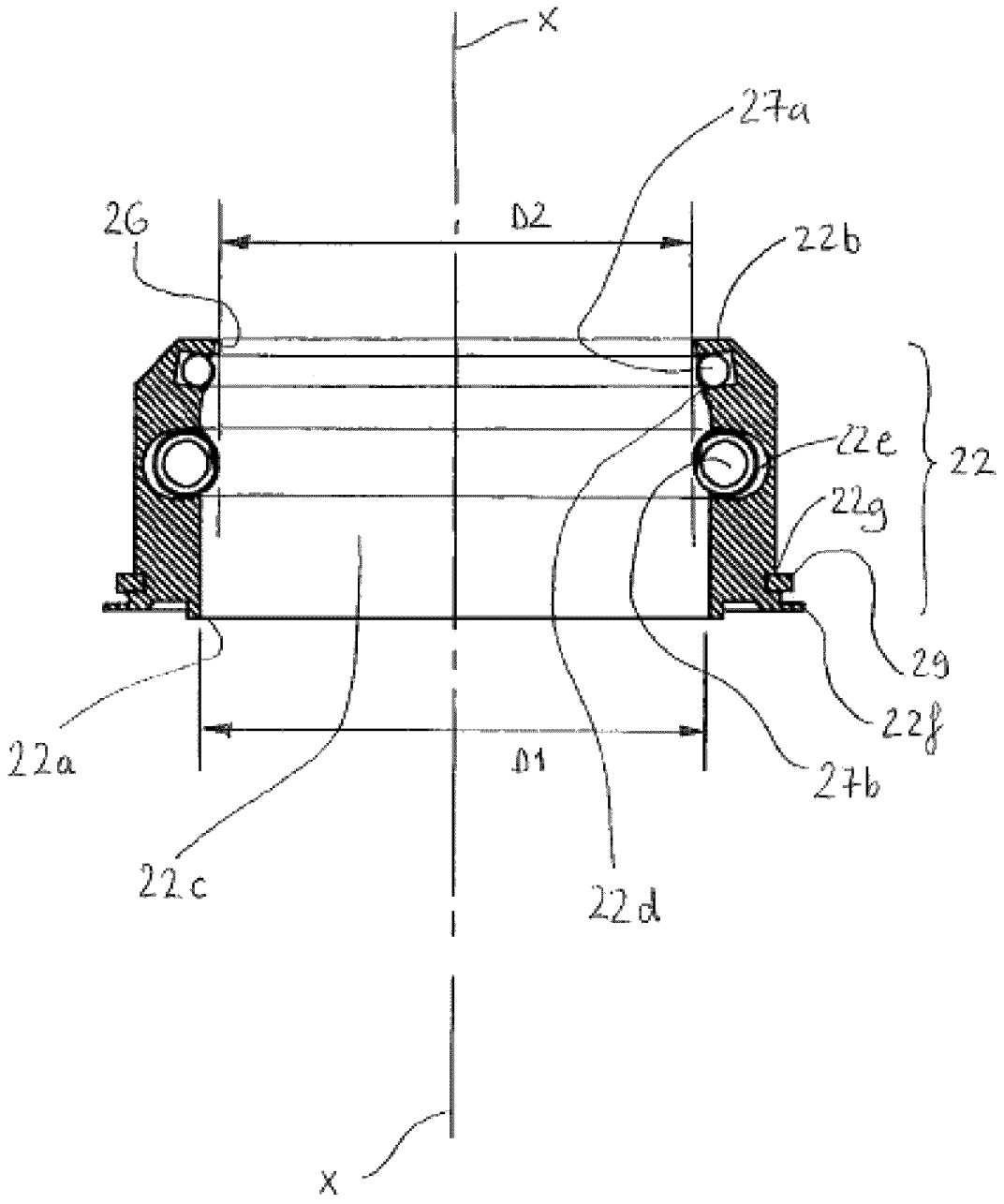
FIG. 10 shows the cross-section III-III of a collar of a base of the light fitting of FIG. 7.

Referring in particular to FIG. 10, the base collar 22 comprises a hollow central channel 22*c* extending from the inner flange 26 to the mouth at the outer end 22*a* of the base collar 22. The central channel 22*c* has a small annular groove 22*d* adjacent the inner flange 26 for receiving an interior small gripping o-ring 27*a*. The small gripping o-ring 27*a* has a cross-sectional diameter of 3 mm although it could be between about 2 mm and 5 mm. Further, the central channel 22*a* has large annular groove 22*e* for receiving an interior large gripping o-ring 27*b* located approximately midway between the inner flange 26 and the mouth at the outer end 22*a* of the base collar 22. The large gripping o-ring 27*b* has a cross-sectional diameter of 6 mm although it could be between about 4 mm and 10 mm, but always about 50% greater than the cross-sectional diameter of the small gripping o-ring 27*a*.

The interior diameter of the mouth 22*a* of the base collar 22 in a plane P orthogonal to the axis X-X is D1. The interior diameter of the inner flange 26 and the large o-ring 27*b* in a plane P orthogonal to the axis X-X is D2. The interior diameter of the small o-ring 27*a* in a plane P orthogonal to the axis X-X is D2, or fractionally more. The interior diameter of the small o-ring 27*a* is less than D1. The interior diameter of the central channel 22*a* tapers gently inwardly from the large o-ring 27*b* towards the small o-ring 27*b* but it is always greater then diameter D2.

The base collar 22 comprises, around the circumferential exterior of the mouth 22*a*, an outer annular trim 22*f* and, nearby, an annular groove 22*g* for receiving an exterior locking o-ring 29. The outer flange 24 is releasably locked between the annular trim 22*f* and the locking o-ring 29.

Figure 11A:
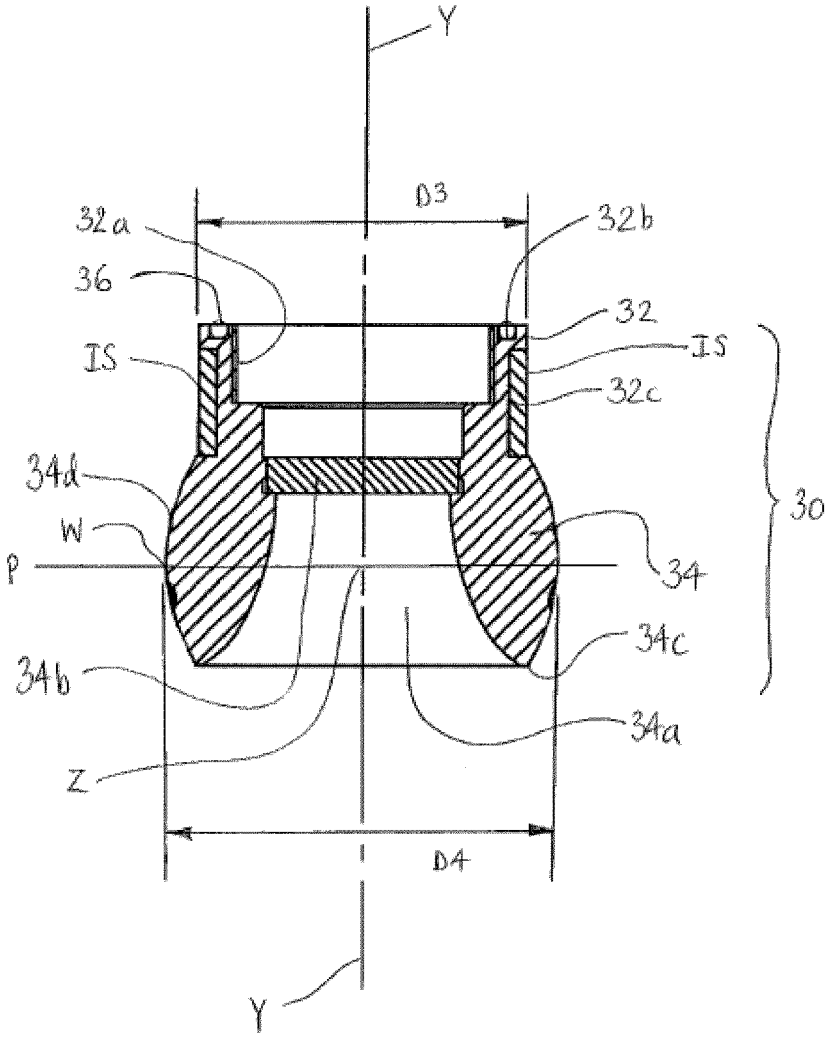
FIG. 11 shows the cross-section III-III of a luminaire support of the light fitting of FIG. 7.
Figure 11B:
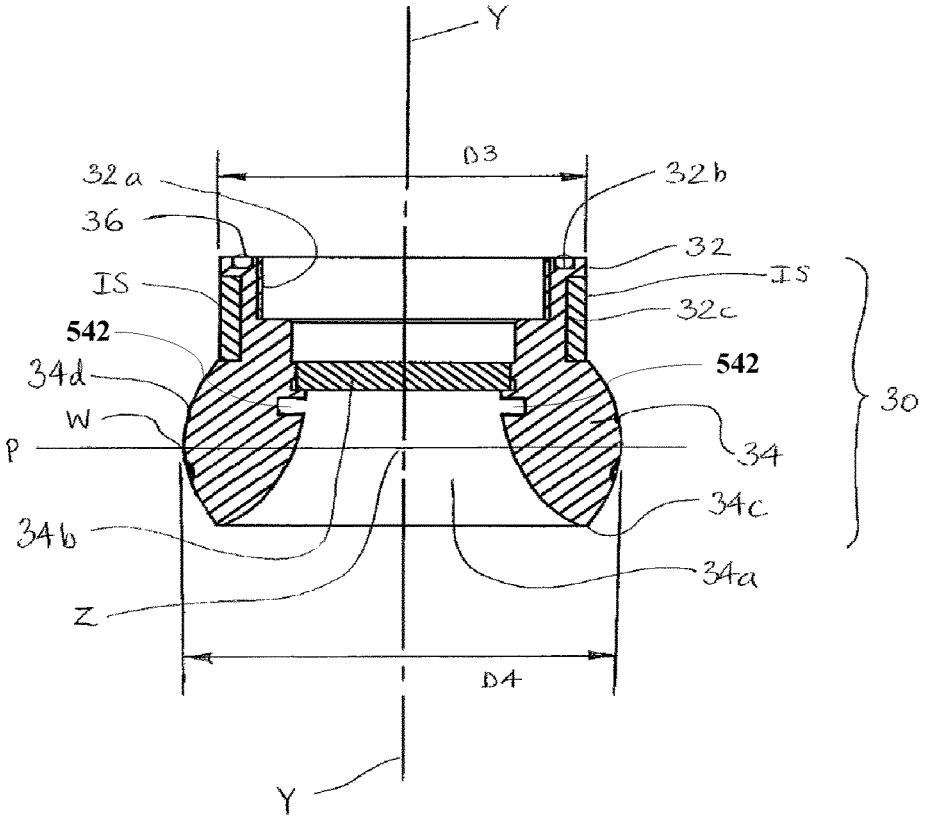

Referring in particular to FIGS. 11*a* and 11*b*, the luminaire support 30 comprises a hollow cylindrical tail portion 32 at an inner end of the luminaire support 30 and an expanded part-spherical head portion 34 at an outer end of the luminaire support 30. The tail 32 and the head 34 portions have a central longitudinal axis Y-Y. The luminaire support 30 may be in line with, and rotated about, the base 20, in which case axes X-X and Y-Y are co-axial. Alternatively, the luminaire support 30 may be pivoted with respect to the base 20, in which case the axis Y-Y may be inclined with respect to the axis X-X, as is explained in more detail below. The tail 32 and the head 34 portions are integral parts, although, optionally, they made be made of separate parts connected together.

The interior 32*a* of the tail portion 32 is threaded for screw-in engagement with the outer end of the luminaire 100. The inner end of the tail portion 32 has an annular channel 32*b* for receiving a sealing o-ring which faces the outer end of the luminaire 100 and seals the join between the luminaire 100 and the tail portion 32 when they are engaged. The circumferential exterior of the tail portion 32 has an annular channel 32*c* for receiving an annular intumescent seal IS. The exterior of the tail portion 32 has an outer diameter D3.

In the case of fire, the intumescent seal IS expands to fill air gaps between the hole H and the light fitting 10 so that the spread of fire is retarded. The intumescent seal, which is preferably provided by a strip of intumescent tape around a circumference of the luminaire support, is preferably configured such that its (or a coating of intumescent material's) expansion in the event of a fire prevents the luminaire from falling from the base. The luminaire support is held in place by a resilient member, as discussed above, and if the resilient member, softens or becomes pliable (an unlikely event) in a fire, the expansion of the intumescent seal on the luminescent support, ideally on a tail portion thereof, further within the base from a base socket-engaging waist of a luminaire support will prevent the luminaire support from falling from the base. Thus the spread of fire, which would be encouraged by the removal of the luminaire support from the base leaving holes in the ceiling substrate which may otherwise act as vents or chimneys, may be retarded.

The interior of the head portion 34 comprises a hollow central channel 34*a* extending from the threaded interior 32*a* of the tail portion 32 to the outer end of the head portion 34. Lodged in the throat of the central channel 34*a* is a transparent lens 34*b*. The diameter of the central channel 34*a* tapers outwardly from the lens 34*b* towards a mouth 34*c* at the outer end of the head portion 34. This is to permit divergence of light projected from the luminaire 100. Preferably, as shown in FIG. 11*b*, the luminaire support 30 is adapted with an annular recess 542 which is disposed in the head portion 34 extending outwardly from the hollow central 34*a*, which recess 542 is configured to inter-engage with protrusions or flange members (502, not shown) of a corresponding luminaire support manipulation tool 500 as described above. The exterior circumference of the head portion 34 has a partially-spherical outer surface 34*d* having a centre Z which is located at the intersection between the axis Y-Y and an orthogonal plane P in line with the waist W of the head portion 34. The diameter of the partially-spherical outer surface 34*d*, which circumscribes the waist W, is diameter D4. In the present embodiment, the partially-spherical outer surface 34*d* circumscribes the whole of the waist W. This provides a smooth interface between the outer spherical surface 34*d* and the small 27*a* and large 27*b* gripping o-rings and the annular inner flange 26. As the skilled addressee would understand, the partially-spherical outer surface 34*d* could be incomplete around the waist W, if necessary for manufacturing or constructional reasons, and yet this would not prohibit an interface with the small 27*a* and large 27*b* gripping o-rings and the annular inner flange 26.

The small o-ring 27*a*, the large o-ring 27*b*, the locking o-ring 29 and the sealing o-ring 36 are all made of a material that is inherently resilient like, for example, rubber.

The luminaire support 30 may be made of any substantially rigid material, provided it is fire retardant, like for example, metal, ceramic, plastic, fibre glass or composite material.

The luminaire 100 comprises a casing 102, a heat sink 104, control electronics (not shown), an annular web 106 and optical elements like, for example, a light source 108, a lens, a reflector 110, a diffusion medium and/or a filter to direct and shape light from the light source. The annular web 106 has a threaded exterior for screw-in connection to the luminaire support 30. The light source may be filament lamp or an LED, for example. The light source receives electrical current from an electrical power supply cable (not shown) leading into the cavity C. LEDs have a lower energy consumption, longer lifespan and greater reliability than filament lamps which make LEDs a preferred option of light source.

Assembly of the light fitting shall now be described.

The luminaire 100 is connected to the luminaire support 30 by threaded engagement between interior 32*a* of the tail portion 32 and the exterior of the web 106. The sealing o-ring 36 is squeezed between the casing 102 and the tail portion 32 to seal any gaps between the luminaire 100 and the luminaire support 30.

The exterior diameter the casing 102 of the luminaire 100 is equal to diameter D3 and the exterior diameter of the rest of the luminaire 100, particularly the heat sink 104, is less than diameter D3. Diameter D3 is less than diameter D2. Thus, the luminaire 100 and the tail portion 32 of the luminaire support 30 are free to pass, in the direction of arrow A, through the base collar 22 and past the inner flange 26.

The diameter D4 is less than the diameter D1. Thus, the waist W of the head portion 34 of the luminaire support 30 is free to pass, in the direction of arrow A, through the mouth 22*a* of the base collar 22.

The diameter D4 is greater than the diameter D2. As the head portion 34 of the luminaire support 30 continues in the direction of arrow A, the outer surface 34*d* approaches, and progressively engages, the large gripping o-ring 27*b*. The user encounters increasing resistance due to friction between the smooth outer surface 34*d* and the large gripping o-ring 27*b* but, as a result of its natural resilience, the large gripping o-ring 27*b* eventually deforms sufficiently to yield to head portion 34 and allow the waist W to pass. The waist W is the most expanded circumference of the outer surface 34*d*. Note that, as far as the large gripping o-ring 27*b* is concerned, the waist W may be tilted from the middle of outer surface 34*d* if the luminaire support 30 and axis Y-Y is tilted with respect to the axis X-X.

Immediately after the waist W has passed, the large gripping o-ring 27*b* returns to its original shape. As a result, the head portion 34 at its waist W is gripped between the large gripping o-ring 27*b* and the inner flange 26. The inner flange 26 is made of substantially rigid material and does not yield to the waist W. The inner flange 26 acts as a hard stop which prevents the head portion 34 from traveling any further in the direction of arrow A.

The interior of the inner flange 26 is shaped to substantially correspond to the outer surface 34*d* of the head portion 34. This helps to reduce friction therebetween. The small gripping o-ring 27*a* is an optional additional feature which also helps to reduce friction by providing an annular cushion between the outer surface 34*d* of the head portion 34 and the inner flange 26. Thus, in normal use, the head portion 34 is held, or squeezed, by an interference fit between the small 27*a* and large 27*b* gripping o-rings. The waist W is accommodated in the annular space between the small 27*a* and large 27*b* gripping o-rings and the central channel 22*c*, which has the interior diameter D1. Sometimes, when the luminaire support 30 is urged in the direction of arrow A, the head portion 34 may squeeze the small gripping o-ring 27*a* to the extend that the head portion 34 is held between the inner flange 26 and large gripping o-ring 27*b*. This could occur if, for example, the light fitting 10 was used in a side of a swimming pool with water pressure continually acting upon the luminaire support 30.

The small 27*a* and large 27*b* gripping o-rings and the locking o-ring 29 help to prevent air drafts passing between the base 20 and the luminaire support 30 and the hole H in the substrate S.

The smooth outer surface 34*d* can slide in relation to the small 27*a* and large 27*b* gripping o-rings and, as mentioned above, the inner flange 26. This provides an adjustable coupling mechanism wherein the head portion 34 is received and retained in the base collar 22 in the manner of a ball and socket i.e. the outer surface 34*d* is like a ball and the small 27*a* and large 27*b* gripping o-rings and the inner flange 26 are like a socket. The luminaire support 30 and the luminaire 100 are adjustable to turn about the axis X-X in the direction of clockwise arrow R or anti-clockwise arrow R'. At the same time, the luminaire support 30 and the luminaire 100 are adjustable to pivot the axis Y-Y in relation to the axis X-X by an angle of up to about 20 degrees and in all directions. Thus, light projected from the luminaire 100 may be directed according to user preferences. The user may accomplish rotational and/or pivotal movement of the luminaire support 30 and the luminaire 100 in relation to the base 20 by manipulating the luminaire support 30 with a commonly available gripping tool.

Disassembly of the light fitting 10 shall now be described.

The luminaire support 30 and the luminaire 100 may be removed from the base 20 by pulling the the luminaire support 20 in the direction of arrow B to reverse the assembly method described above. The large gripping o-ring 27*b* recovers its original shape moments after the waist W of the head portion 34 has passed. Thus, the light fitting 10 is prepared for rapid re-assembly.

Whist assembly may be accomplished by the user pushing directly on the luminaire support in the direction of arrow A, disassembly is may be accomplished when the user manipulates the luminaire support 30 with a luminaire manipulating tool 500 as described above.

The advantage with the adjustable coupling mechanism described above is that it permits attachment, detachment and angular adjustment of the luminaire support 30 in relation to the base 20. This is achieved with a simple, efficient and durable design.

The invention has been described with reference to a preferred embodiment. However, it will be appreciated that variations and modifications can be effected by a person of ordinary skill in the art without departing from the scope of the invention.

Further aspects and/or embodiments of the invention are described in the following clauses:

Clause 1: A luminaire or luminaire support having a head portion at its outer end and formed therein a central hollow channel defined by an internal surface of the head portion which channel extends outwards to a mouth for the escape and direction of light from the luminaire, wherein one or more laterally extending protrusions and/or recesses are formed by the internal surface extending into or from the central hollow channel for inter-engagement with a correspondingly configured luminaire support tool.

Clause 2: A luminaire or luminaire support according to clause 1, wherein a laterally extending annular recess is formed by the internal surface extending from the central hollow channel for inter-engagement with a correspondingly configured luminaire support tool.

Clause 3: A method of manipulating a luminaire support the method comprises providing a luminaire support as defined in clause 1 or 2 or elsewhere herein having one or more recess formed in a hollow central channel in the luminaire support, which recess is configured to receive a corresponding protrusion; providing a luminaire support tool such as as described herein having one or more laterally extending protrusion for inter-engagement with a recess of the luminaire support; causing the tool to adopt a second released configuration in which its one or more protrusions are retracted; passing an operational end of the tool via a mouth of the luminaire support into a hollow central channel defined by an internal surface of the luminaire support to a position whereby the retracted protrusion are aligned with the corresponding one or more recess of the luminaire support; actuating the tool to cause it to adopt a first engaged configuration whereby the protrusions extend into to inter-engage with the one or more recess of the luminaire support; and whilst in inter-engagement, manipulating the tool in order to correspondingly manipulate the luminaire support in the desired manner.

Clause 4: A method according to clause 3, which further comprises releasing the tool from the luminaire support by reversing actuation of the tool to disengage the protrusions from the recess and extracting the tool from the central hollow channel of the luminaire support.

Clause 5: A light fitting for recessed mounting of a luminaire in a substrate, the light fitting comprising:

a luminaire support having an expanded waist portion; and a base having a socket portion arranged to receive the waist portion, wherein angular orientation of luminaire support in relation to the base is adjustable by way of relative movement between the socket portion and the waist portion and wherein at least one of the socket portion or waist portion has a resilient member arranged to releasably retain the waist portion in the socket portion.

Clause 6: A light fitting according to clause 5, wherein relative movement between the socket portion and the waist portion is supported by an at least partially spherical surface on at least one of the socket portion and the waist portion.

Clause 7: A light fitting according to clause 6, wherein the or each partially spherical surface circumscribes the socket portion or waist portion.

Clause 8: A light fitting according to either of clauses 6 or 7, wherein the at least partially spherical surface is on one of the socket portion or the waist portion and the other of the socket portion or the waist portion comprises a stop arranged to support the at least partially spherical surface between the stop and the resilient member.

Clause 9: A light fitting according to clause 8, wherein the stop comprises an at least partially annular flange circumscribing the other of the socket portion or the waist portion.

Clause 10: A light fitting according to clause 9, wherein the flange circumscribes a channel through the base.

Clause 11: A light fitting according to either of clauses 9 or 10, wherein the light fitting comprises a cushion between the stop and the at least partially spherical surface.

Clause 12: A light fitting according to clause 11, wherein the cushion comprises an o-ring.

Clause 13 A light fitting according to any of clauses 5 to 12, wherein the resilient member comprises an o-ring.

Clause 14: A light fitting according to any one of clauses 5 to 13, wherein the base comprises a collar configured for recessed mounting in a substrate.

Clause 15: A light fitting according to clause 14, wherein the outer end of the base comprises an outer flange configured for engagement with a substrate.

Clause 16: A light fitting according to clauses 5 to 14, wherein the light fitting further comprises a luminaire connected to the luminaire support.

Clause 17: A light fitting according to clause 16, wherein the luminaire is releasably connected to the luminaire support.

Clause 18: A light fitting according to clause 16, wherein the luminaire support is integral with the luminaire.

Clause 19: A light fitting according to any one of clauses 5 to 18, wherein the waist portion is releasable from the socket portion by way of manipulation with a tool.

Clause 20: A light fitting according to any one of clauses 5 to 19 adapted for use in a system of the first aspect of the invention.

Clause 21: A light fitting according to clause 20, wherein the luminaire support has a central hollow channel formed therein defined by an internal surface thereof and a laterally extending recess extending from the hollow channel for receiving protrusions or flange members of a corresponding manipulation tool for inter-engagement therewith.

Clause 22: A base having a socket portion arranged to receive an expanded waist portion of a luminaire support of the light fitting according to any one of clauses 6 to 21 when ultimately dependent on clause 6, wherein angular orientation of luminaire support in relation to the base is adjustable by way of relative movement between the socket portion and the waist portion, wherein said relative movement is supported by an at least partially spherical surface on at least one of the socket portion and the waist portion and wherein at least one of the socket portion or waist portion has a resilient member arranged to releasably retain the waist portion in the socket portion.

Clause 23: A luminaire support having an expanded waist portion to be received in a socket portion of a base of the light fitting according to any one of clauses 6 to 21 when ultimately dependent on clause 6, wherein orientation of luminaire support in relation to the base is adjustable by way of relative movement between the socket portion and the waist portion, wherein said relative movement is supported by an at least partially spherical surface on at least one of the socket portion and the waist portion and wherein at least one of the socket portion or waist portion has a resilient member arranged to releasably retain the waist portion in the socket portion.

Optionally, the luminaire support described herein may form a luminaire assembly in combination with a luminaire element.

Clause 24: A tool moveable between a first configuration and a second configuration having an elongate handle portion and at a distal end thereof an operational portion separated from the handle portion by a pivot joint, wherein the tool comprises two tool halves each having opposing internal facing surfaces defining respective surface planes, wherein the surface plane of each handle portion is disposed at an obtuse angle to the surface plane of each operational portion, whereby the tool halves may be caused to pivot about the pivot joint between the first configuration in which opposing surface planes of the operational portion of each tool half is brought together and the second configuration in which opposing surface planes of the handle portion of each tool half is brought together.

Clause 25: A tool according to clause 24, wherein each tool half is formed by moulding in a mould.

Clause 26: A tool according to clause 24 or 25, wherein each tool half comprises a handle portion an operational portion and therebetween a pivot joint half.

Clause 27: A tool according to clause 24 to 26, wherein the pivot joint comprises a roller bearing disposed in a cavity formed by corresponding pivot joint halves of each tool half when brought together.

Clause 28: A tool according to any one of clauses 24 to 27, wherein the tool halves are held together to form the tool by resiliently flexible retention members disposed around the two halves.

Clause 29: A tool according to clause 28, wherein there are two retention members which are o-rings disposed in channels configured to receive them.

Clause 30: A tool according to any one of clauses 24 to 29, which further comprises a laterally outward extending flange member disposed on the operational portion of each tool half whereby in its first configuration the flange members are in retracted configuration and in its second configuration the flange members are in extended configuration.

Clause 40: Use of an intumescent seal (or an intumescent tape) to retard the spread of fire by disposing said seal or tape on a tail portion of a luminaire support such as defined herein whereby in the event of fire, the intumescent seal or tape expands so as to prevent the luminaire support from falling from the base.

Each of the embodiments defined by the above clauses may be incorporated, where appropriate in the context, into a light fitting, light fitting system, luminaire assembly according to the aspects of the invention set out above.

The invention claimed is:

1. A light fitting system comprising a light fitting for recessed mounting of a luminaire in a substrate, the light fitting comprising a luminaire support and a base for receiving the luminaire support; and a luminaire support tool for manipulating the luminaire support in relation to the base of the light fitting, wherein the luminaire support and the luminaire support tool are configured for cooperative inter-engagement whereby the tool may be releasably inter-engaged with the luminaire support to enable manipulation of the luminaire support in relation to the base, wherein the tool is a hand tool, wherein the tool has a first configuration in which the tool adopts an engaged configuration in which it can be cooperatively inter-engaged with a corresponding luminaire support and a second configuration in which the tool adopts a released configuration in which it may not be cooperatively inter-engaged with a luminaire support and may be moved independently of the luminaire support, wherein the luminaire support has an expanded waist portion; and the base has a socket portion arranged to receive the waist portion, wherein angular orientation of luminaire support in relation to the base is adjustable by way of relative movement between the socket portion and the waist portion and wherein at least one of the socket portion or waist portion has a resilient member arranged to releasably retain the waist portion in the socket portion, and wherein relative movement between the socket portion and the waist portion is supported by an at least partially spherical surface on at least one of the socket portion and the waist portion.

2. The light fitting as claimed in claim 1, wherein the base and luminaire support are configured such that the base may removably receive the luminare support and/or enable angular adjustment of the luminaire support within the base and wherein the manipulation of the luminaire support comprises one or more of fitting, removing and adjusting the luminaire support in relation to the base.

3. The light fitting system as claimed in claim 1, wherein the base has a socket portion for removably receiving the luminaire support and wherein the luminaire support and the tool are configured to enable fitting and/or removal of the luminaire support into or from the socket portion of the base.

4. The light fitting system as claimed in claim 1, wherein the luminaire support and the tool are configured with one or more cooperating recesses and protrusions for cooperative inter-engagement, which are a laterally extending recess and a laterally extending protrusion.

5. The light fitting system as claimed in claim 4, wherein the luminaire support has an interior surface defining a hollow central channel, longitudinally disposed in the luminaire, configured to receive passage of the tool and wherein the laterally extending recess is disposed in the interior surface and extends from the hollow central channel.

6. The light fitting system as claimed in claim 3, wherein the base comprises a base collar defining the socket portion and having an outer opening or mouth and wherein the luminaire support may be fitted and removed from the socket portion via the mouth.

7. The light fitting system as claimed in claim 1, wherein the at least partially spherical surface is on one of the socket portion or the waist portion and the other of the socket portion or the waist portion comprises a stop arranged to support the at least partially spherical surface between the stop and the resilient member, wherein the stop comprises an at least partially annular flange circumscribing the other of the socket portion or the waist portion.

8. The light fitting system as claimed in claim 7, wherein the light fitting comprises a cushion, said cushion comprising an o-ring, between the stop and the at least partially spherical surface.

9. The light fitting system as claimed in claim 1, wherein the resilient member comprises an o-ring.

10. The light fitting system as claimed in claim 1, wherein the base comprises a collar configured for recessed mounting in a substrate and wherein an outer end of the base comprises an outer flange configured for engagement with a substrate.

11. The light fitting system as claimed in claim 1, wherein the light fitting further comprises a luminaire releasably connected to the luminaire support.

12. The light fitting system as claimed in claim 1, wherein an intumescent seal is provided about the circumference of the luminaire support in a manner such that in the event of failure of the resilient member the intumescent seal prevents the luminaire support from falling from the base.

13. The light fitting system as claimed in claim 12, wherein the intumescent seal is provided by a strip of intumescent tape disposed in an annular channel formed in a tail of the luminaire support.

14. The light fitting system as claimed in claim 1, which comprises an elongate handle portion and disposed on a distal end thereof an operational portion, wherein the operational portion is provided with one or more protrusions and/or recess for inter-engagement with one or more corresponding recesses and/or protrusions disposed on a luminaire support.

15. The light fitting system as claimed in claim 14, wherein the operational portion is provided with two laterally outwardly extending protrusions.

16. The light fitting system as claimed in claim 1 having a head portion at its outer end and formed therein a central hollow channel defined by an internal surface of the head portion which channel extends outwards to a mouth for the escape and direction of light from the luminaire, wherein one or more laterally extending protrusions and/or recesses are formed by the internal surface extending into or from the central hollow channel for inter-engagement with a correspondingly configured luminaire support tool.

17. A light fitting system comprising a light fitting for recessed mounting of a luminaire in a substrate, the light fitting comprising a luminaire support and a base for receiving the luminaire support; and a luminaire support tool for manipulating the luminaire support in relation to the base of the light fitting, wherein the luminaire support and the luminaire support tool are configured for cooperative inter-engagement whereby the tool may be releasably inter-engaged with the luminaire support to enable manipulation of the luminaire support in relation to the base, wherein the tool is a hand tool, wherein the tool has a first configuration in which the tool adopts an engaged configuration in which it can be cooperatively inter-engaged with a corresponding luminaire support and a second configuration in which the tool adopts a released configuration in which it may not be cooperatively inter-engaged with a luminaire support and may be moved independently of the luminaire support, wherein the luminaire support has an expanded waist portion; and the base has a socket portion arranged to receive the waist portion, wherein angular orientation of luminaire support in relation to the base is adjustable by way of relative movement between the socket portion and the waist portion and wherein at least one of the socket portion or waist portion has a resilient member arranged to releasably retain the waist portion in the socket portion, and wherein an intumescent seal is provided about the circumference of the luminaire support in a manner such that in the event of failure of the resilient member the intumescent seal prevents the luminaire support from falling from the base, wherein the intumescent seal is provided by a strip of intumescent tape disposed in an annular channel formed in a tail of the luminaire support.

18. A light fitting for recessed mounting of a luminaire in a substrate, the light fitting comprising a luminaire support and a base for receiving the luminaire support, wherein the luminaire support has an expanded waist portion and the base has a socket portion arranged to receive the waist portion, wherein angular orientation of luminaire support in relation to the base is adjustable by way of relative movement between the socket portion and the waist portion and wherein at least one of the socket portion or waist portion has a resilient member arranged to releasably retain the waist portion in the socket portion, wherein relative movement between the socket portion and the waist portion is supported by an at least partially spherical surface on at least one of the socket portion and the waist portion.

* * * * *